United States Patent [19]

Ogata et al.

[11] Patent Number: 4,985,283

[45] Date of Patent: Jan. 15, 1991

[54] METHOD AND DEVICE FOR PAINTING SIDE OUTER PANELS OF AN AUTOMOBILE BODY

[75] Inventors: Kentarou Ogata; Satoshi Kodama; Masashi Murate, all of Toyota, Japan

[73] Assignee: Toyota Jidosha Kabushiki Kaisha, Toyota, Japan

[21] Appl. No.: 414,744

[22] Filed: Sep. 27, 1989

Related U.S. Application Data

[63] Continuation of Ser. No. 883,648, Jul. 9, 1986, abandoned.

[30] Foreign Application Priority Data

Aug. 24, 1985 [JP] Japan ..... 60-185026

[51] Int. Cl.[5] ..... B05D 1/02

[52] U.S. Cl. ..... 427/424; 118/314; 118/323; 118/631; 118/697; 901/43; 427/33

[58] Field of Search ..... 118/314, 315, 316, 323, 118/324, 631, 626, 697; 427/27, 33, 424, 421; 901/43

[56] References Cited

U.S. PATENT DOCUMENTS

| | | | |
|---|---|---|---|
| 2,321,982 | 1/1941 | Brackett | 118/316 |
| 2,840,037 | 6/1958 | Verba | 118/321 X |
| 3,022,011 | 2/1962 | Hegyi | 118/323 X |
| 3,081,736 | 3/1963 | Brady, Jr. | 118/323 |
| 3,255,037 | 6/1966 | Knight et al. | 118/698 |
| 3,279,421 | 4/1963 | Tilney et al. | 118/323 |
| 3,402,697 | 9/1968 | Kock | 118/323 X |
| 3,561,398 | 2/1971 | Rose et al. | 118/697 |
| 3,709,190 | 1/1973 | Von Gottberg et al. | 118/697 |
| 4,278,046 | 6/1978 | Clarke et al. | 118/697 |

FOREIGN PATENT DOCUMENTS

| | | | |
|---|---|---|---|
| 684652 | 4/1964 | Canada | 427/33 |
| 54-11945 | 1/1979 | Japan . | |
| 58-81457 | 5/1983 | Japan . | |
| 59-16823 | 4/1984 | Japan . | |
| 59-21670 | 5/1984 | Japan . | |
| 2087269 | 5/1982 | United Kingdom | 118/316 |

OTHER PUBLICATIONS

English Translation of Japanese Kokai Patent No. Sho 54–11945; PTO–1698; Jun., 1988.

*Primary Examiner*—Shrive Beck
*Assistant Examiner*—Alain Bashore
*Attorney, Agent, or Firm*—Oblon, Spivak, McClelland, Maier & Neustadt

[57] ABSTRACT

A spray painting device having a first spray mechanism and a second spray mechanism located downstream of the first spray mechanism in an assembly line along which an automobile body is conveyed. A spray head of the first spray mechanism is fixed at a constant height when spraying paint onto a side outer panel portion which is situated over a front or rear wheel of the automobile chassis, and is moved up and down when spraying paint onto a side outer panel portion which is not situated over the front or rear wheel. A spray head of the second spray mechanism is located so that a constant distance is maintained between the spray heads and the side outer panel to spray a uniform coat of paint onto the side outer panel.

5 Claims, 8 Drawing Sheets

METHOD AND DEVICE FOR PAINTING SIDE OUTER PANELS OF AN AUTOMOBILE BODY

This application is a continuation of application Ser. No. 883,648, filed on July 9, 1986, now abandoned.

BACKGROUND OF THE INVENTION

1. Field of the Invention

The present invention relates to a method and device for painting right and left side outer panels of an automobile body.

2. Description of the Related Art

Painting an outer panel of an automobile body is generally carried out by rotary type electrostatic spray painting devices located, for example, on the right and left of and over an assembly line along which the automobile is moved, and a portion of the outer panel in front of the electrostatic spray painting device is sprayed with paint as the panel passes in front of the painting device.

Portions of the right and left side outer panels situated over the front and rear wheels of an automobile chassis have a shorter vertical length than other portions, and to paint these shorter portions, commonly the spray heads of the electrostatic spray painting device are located above and below a central horizontal plane of the side outer panels of the body to be painted (Japanese Unexamined Patent Publication No. 54-11945). In this construction, a distance between the outer panel and the spray head is always constant, and therefore, the line of force of the static electricity of the particles of paint is stable, and thus a good painted surface is obtained. Since, however, the side outer panels are divided into 2 or 3 portions for painting, 4 to 6 spray heads are necessary for one coating, and therefore, the painting system requires a large space in which to locate so many spray heads, and thus equipment costs become relatively high.

An electrostatic spray painting device disclosed in Japanese Examined Patent Publication No. 59-21670 is constructed in such a manner that the spray heads move up and down along a vertical line to enable side outer panels to be painted by one spray head, so that the number of spray heads needed by the painting device is drastically reduced. However, in this painting device, since the spray head moves away from the side outer panel during reciprocation of the spray head, because of a configuration of the side outer panel, the electrostatic charge of the paint particles may be lost. In this case paint particles that have lost their electrostatic charge will adhere to the side outer panel and the quality of the painted surface thereof is degraded.

Japanese Unexamined Patent Publication No. 58-81457 discloses a construction in which paint is sprayed onto the side outer panels by spray heads moving along an outline of the panels.

SUMMARY OF THE INVENTION

Therefore, an object of the present invention is to provide a method and device for painting side outer panels by which a superior quality painted surface is obtained by using a small number of spray heads, and two coats of paint can be applied within a relatively small area of the assembly line.

According to the present invention, there is provided a method comprising a first spraying step and a second spraying step. In the first spraying step, paint is sprayed onto first outer panel portions of an automobile body which are situated over the front and rear wheels of an automobile chassis by spray heads fixed at a point substantially midway between the top and bottom of the first outer panel portions, and is sprayed onto second outer panel portions of the automobile body which are not situated over the front and rear wheels of the automobile chassis while the spray heads are moved up and down about a point substantially midway between the top and bottom of the second outer panel portions. In the second spraying step, paint is uniformly sprayed onto the first and second outer panel portions and the spray heads are located in such a manner that a substantially constant distance is maintained between the spray heads and the outer panel portions. The second spraying step is carried out after the first spraying step.

Further, according to the present invention, there is provided a device comprising a first spray mechanism and a second spray mechanism. The first spray mechanism has first spray heads located adjacent to the side outer panels, and the mechanism moves the first spray heads up and down. The first spray heads spray paint onto the first outer panel portions while fixed at a point substantially midway between the top and bottom of the first outer panel portions, and spray paint onto the second outer panel portions while moving up and down about a point substantially midway between the top and bottom of the second outer panel portions. The second spray mechanism has second spray heads and a supporting mechanism supporting the second spray heads. The second spray heads are located adjacent to the side outer panels and downstream of the first spray heads, and are positioned by the supporting mechanism in such a manner that a substantially constant distance is maintained between the spray heads and the side outer panels while spraying paint uniformly thereon.

BRIEF DESCRIPTION OF THE DRAWINGS

The present invention may be more fully understood from the description of preferred embodiments of the invention set forth below, together with the accompanying drawings, in which.

DESCRIPTION OF THE PREFERRED EMBODIMENTS

The present invention will now be described with reference to the attached drawings.

Figure 1:
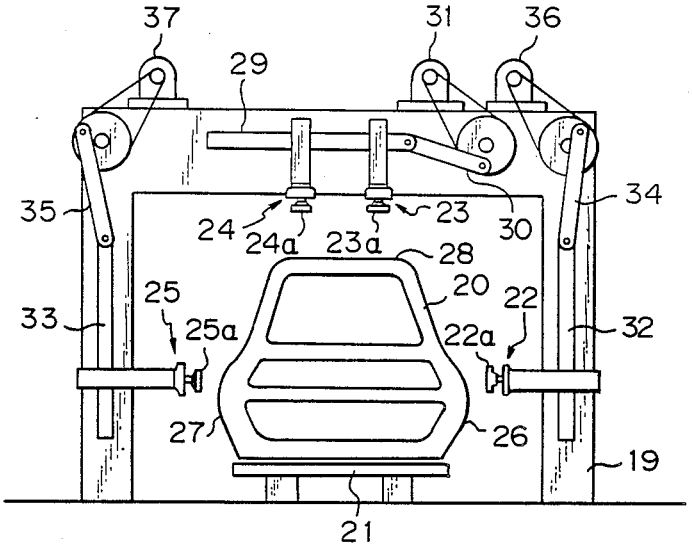
FIG. 1 shows a front view of a rotary type electrostatic spray painting device having horizontally reciprocating spray heads and vertically reciprocating spray heads.

FIG. 1 shows vertically-reciprocating rotary type electrostatic spray painting devices having spray heads which reciprocate vertically to spray paint onto side outer panels of an automobile body, and horizontally-reciprocating rotary type electrostatic spray painting devices having spray heads which reciprocate horizontally to spray paint onto upper outer panels of the automobile body.

In FIG. 1, the automobile body 20 is carried by a conveyor 21 at a constant speed along an assembly line, and paint is sprayed onto the body 20 by the rotary type electrostatic spray painting devices 22, 23, 24, and 25 attached to a gantry frame 19, while the body 20 is moved along the assembly line by the conveyor 21. The rotary type electrostatic spray painting devices 22 and 25 have spray heads **22*a* and 25*a* which spray paint onto side outer panels 26 and 27 of the body 20, and the rotary type electrostatic spray devices 23 and 24 have spray heads 23*a* and 24*a* which spray paint onto an upper outer panel (roof) 28 of the automobile body 20. The spray heads 22*a*, 23*a*, 24*a*, and 25*a* are located at positions adjacent to the side and upper outer panels of the body 20. The rotary type electrostatic spray painting devices 23 and 24 are carried by a slider 29 which is horizontally and slidably supported on the frame 19; the slider 29 being moved to the left and right through a crank 30 and a motor 31. The rotary type electrostatic spray painting devices 22 and 25 are carried by sliders 32 and 33, respectively, which are vertically and slidably supported on the frame 19; the sliders 32 and 33 being moved up and down through corresponding cranks 34 and 35 and motors 36 and 37**.

Figure 2:
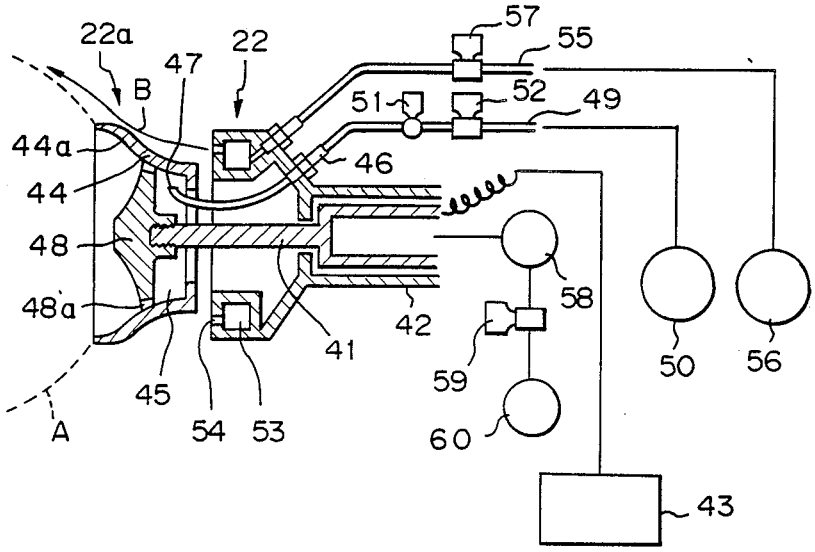
FIG. 2 shows a sectional view of a spray head of a rotary type electrostatic spray painting device.

Each of the rotary type electrostatic spray painting devices 22, 23, 24, and 25 has the same construction, and therefore, only the construction of the rotary type electrostatic spray painting device 22 will be explained, with reference to FIG. 2. The spray head **22*a* is threadingly fixed on a tip portion of a rotary shaft 41 which is rotatably supported in a housing 42 of the electrostatic spray painting device 22. The rotary shaft 41 is connected to a high voltage generating device 43 which can selectively generate a high negative voltage of between −60 KV and −120 KV, and therefore, a high negative voltage is applied to the spray head 22*a* through the rotary shaft 41. The spray head 22*a* has a cup 44 and a disk 48 engaging with the cup 44 and threadingly fixed to the shaft 41. The cup 44 has a cup-shaped inner surface 44*a*, and the cup 44 and the disk 48 define an annular space 45 around the rotary shaft 41. A paint spray nozzle 46 is provided along the rotary shaft 41, and a nozzle port 47 of the paint spray nozzle 46 is disposed in the annular space 45. Paint outlet ports 48*a* are formed on a periphery of the disk 48. The paint spray nozzle 46 is connected to a paint supply pump 50 through a paint supply tube 49 provided with an ON-OFF valve 51 and a paint control valve 52. An annular air chamber 53 is formed around the rotary shaft 41 in the housing 42, and has a number of air injection ports 54 along an outer periphery thereof. The annular air chamber 53 is connected to a compressed air source 56 through an air supply tube 55 provided with an air control valve 57. The rotary shaft 41 is rotated by an air turbine 58. A turbine nozzle (not shown) injecting compressed air onto turbine blades of the air turbine 58 is connected to a compressed air source 60 through a line provided with an air control valve 59**.

At the start of a painting operation, first, the rotary shaft 41 is rotated by the turbine 58 and a negative high voltage is applied to the spray head **22*a* through the rotary shaft 41. Then, paint is injected through the nozzle port 47 of the paint spray nozzle 46, and air is injected through the air injection ports 54 of the annular air chamber 53. The paint injected through the nozzle port 47 is caused to flow from the paint outlet ports 48*a* to the inner surface 44*a* by a centrifugal force generated by the rotation of the spray head 22*a*. This paint forms a thin liquid film on the inner surface 44*a*, and spreads to reach a tip portion of the spray head 22*a*. Thus the paint is discharged from the tip portion of the spray head 22*a* as shown by a broken line A. As described above, a high negative voltage is applied to the spray head 22*a*, and therefore, the paint particles are given a negative charge. Accordingly, since the automobile body 20 is earthed, the paint particles are drawn toward the automobile body 20 by an electrostatic line of force, and thus a coating of paint is formed on the automobile body 20. Air injected through the air injection port 54 of the annular air chamber 53** forms an air-envelope around the sprayed paint (shown by A) as shown by a solid line B, so that an angle of spread of the sprayed paint is controlled.

Figure 3:
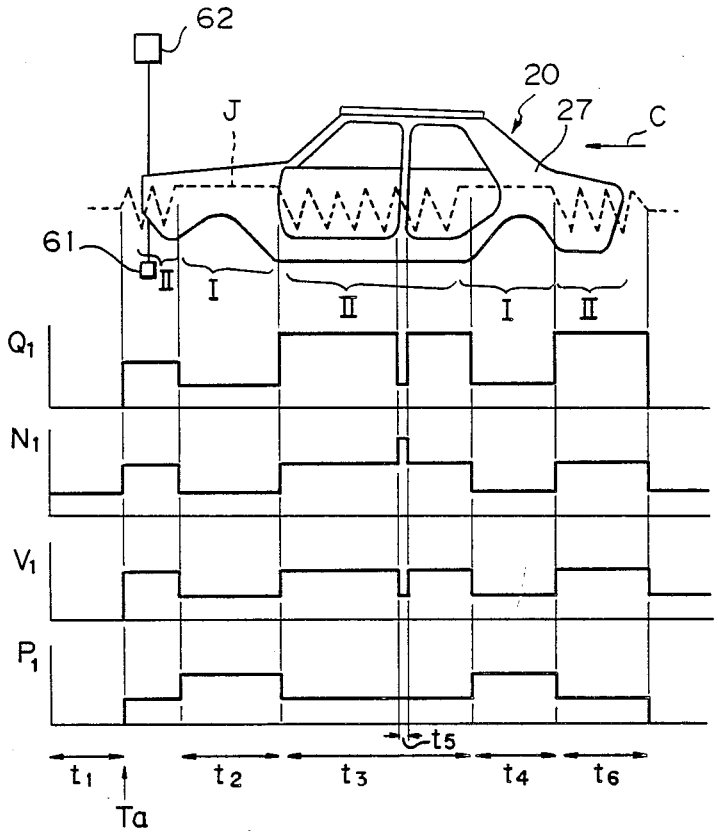
FIG. 3 shows a time chart of a painting process by the vertically reciprocating spray head.

In FIG. 3, the automobile body 20 to be painted is moved by the conveyor 21 (FIG. 1) in the direction shown by an arrow C, and a light source 61 and a photoelectric switch 62 are disposed on both sides of a passage way through which the automobile body 20 will pass. Light emitted from the light source 61 reaches the photoelectric switch 62, which senses the light. When the automobile body 20 interrupts the light from the light source 61, the light does not reach the photoelectric switch 62, and thus the photoelectric switch 62 outputs a paint operation start signal.

Figure 4:
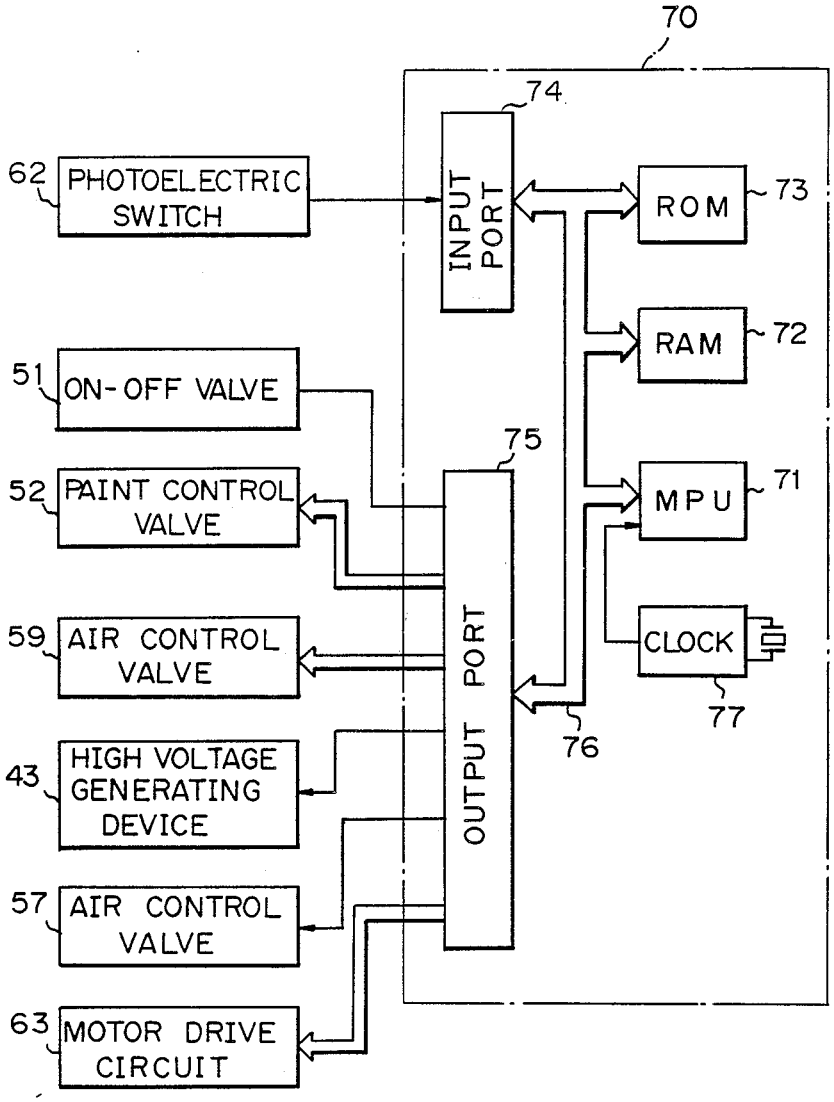
FIG. 4 shows a block diagram of an electronic control unit.

FIG. 4 shows an electronic control unit 70. The electronic control unit 70 consists of, for example, a digital computer, and has a microprocessor unit (MPU) 71 carrying out certain calculations, a random access memory (RAM) 72, a read only memory (ROM) 73 storing a control program, a calculation coefficient and so on, an input port 74, and an output port 75, and these elements are interconnected by a bus line 76. The electronic control unit 70 further has a clock generator 77 generating specified clock signals.

As shown in FIG. 4, the paint operation start signal output from the photoelectric switch 62 is input to the MPU 71 through the input port 74 and the bus line 76. Thus, when the paint operation start signal is output from the photoelectric switch 62, data for driving the ON-OFF valve 51, the paint control valve 52, the air control valve 59, the high voltage generating device 43, the air control valve 57, and the motor drive circuit 63 is written in the output port 75, in accordance with a program stored in the ROM 73. Therefore, in accordance with the data written in the output port 75, the ON-OFF valve 51 controls the start and stop of paint injection into the paint spray nozzle 46; the paint control valve 52 controls the amount of paint supplied, i.e., large, medium or small amount; the air control valve 59 controls the number of revolutions, i.e., speed, of the rotary shaft 41 to a high, middle or low value by controlling the quantity of air supplied to the turbine 58; the high voltage generating device 43 switches the negative high voltage applied to the spray head 22*a* to a high or low voltage; the air control valve 57 controls the quantity of air injected from the air injection port 54 of the annular air chamber 53, i.e., large or small quantity; and the motor drive circuit 63 controls the start rotation/-stop rotation of the motors 36 and 37.

The operation of the spray painting device according to the present invention is described below with reference to FIG. 3, showing a time chart. The automobile body 20 has first outer panel portions I which are situated over the front and rear wheels of the automobile chassis, and second outer panel portions II which are not situated over the wheels. In this FIG. 3, the broken line J drawn on a side outer panel 27 of the automobile body 20 shows a line of movement of the spray heads 22*a* and 25*a* of the rotary type electrostatic spray painting devices 22 and 25. This line of movement is controlled by the drive motors 36 and 37 according to signals output from the electronic control unit 70, as described above. In FIG. 3, $Q_1$ shows the amount of paint supplied as controlled by the ON-OFF valve 51 and the paint control valve 52; $N_1$ shows the number of revolutions of the rotary shaft 41 controlled by the air control valve 59; $V_1$ shows the negative high voltage generated by the high voltage generating device 43; and $P_1$ shows the quantity of air injected from the air injection port 54 controlled by the air control valve 57.

During a period $t_1$ in which the automobile body 20 does not interrupt the light emitted from the light source 61, the supply of paint is stopped as shown by $Q_1$. During this period, the rotary shaft 41 rotates slowly as shown by $N_1$. Then, the automobile body 20 interrupts light emitted from the light source 61 at a time $T_a$, so that the supply of paint is started and the rotary shaft 41 starts to rotate at a middle speed, and a high voltage is generated by the high voltage generating device 43, as shown by $V_1$, so that painting of the side outer panel in front of a front wheel, that is, the second outer panel portion II, is started. At the same time, the drive motors 36 and 37 are driven so that the spray heads 22*a* and 25*a* are moved up and down about a point substantially midway between the top and bottom of the outer panel portions, and a small quantity of air is injected from the air injection port 54 as shown by $P_1$.

Then, during a period $t_2$, the spray heads 22*a* and 25*a* face a first outer panel portion I situated over a front wheel, and the spray heads 22*a* and 25*a* are fixed at a point substantially midway between the top and bottom of the outer panel portion I to spray paint thereon. During this period $t_2$, the paint injection quantity $Q_1$, the number of revolutions $N_1$ of the rotary shaft 41, and the output voltage $V_1$ of the high voltage generating device 43 are reduced, and the quantity of air injected $P_1$ from the air injection port 54 is increased. Therefore, the spray heads 22*a* and 25*a* spray a relatively small quantity of paint onto the outer panel portion I, and the angle of spread of the sprayed paint is relatively narrow. The same operations are carried out during a period $t_4$, when the spray heads 22*a* and 25*a* face another first outer panel portion I situated over a rear wheel.

At a period $t_3$, during the painting of the outer panel portion II between the front and rear wheels the paint injection quantity $Q_1$ is increased, the rotary shaft 41 is rotated at a high speed, a high voltage is generated from the high voltage generating device 43, and a small quantity of air is injected through the air injection port 54. Therefore, the spray heads 22*a* and 25*a* spray a relatively large quantity of paint into the outer panel portion II, and the angle of spread of the sprayed paint is relatively wide. During a period $t_5$, the center pillar portion is painted, and the paint injection quantity $Q_1$ and output voltage of the high voltage generating device 43 are decreased, and the rotary shaft 41 is rotated at a slow speed. Note that, during the period $t_3$, the drive motors 36 and 37 are driven to move the spray heads 22*a* and 25*a* up and down about a point substantially midway between the top and bottom of the outer panel portion II.

After painting of the outer panel portion I situated over the rear wheel carried out during the period $t_4$ is completed, the paint injection quantity $Q_1$, the number of revolutions of the rotary shaft 41, and an output voltage from the high voltage generating device 43 are increased, the quantity of air injected $P_1$ from the air injection port 54 is decreased, and the spray heads 22*a* and 25*a* are moved up and down to paint the second outer panel portions II for a period $T_6$.

The painting operation is completed when the rear end of the automobile body 20 passes the photoelectric switch 61 and light emitter 62 to allow light to be received by the switch 61, thereby turning the switch 61 OFF. Note, that the point at which the spray heads 22*a* and 25*a* are fixed when the first outer panel portions I are painted may be positioned higher than the topmost point of the line of movement of the spray heads 22*a* and 25*a* while the second outer panel portions II are painted.

Figure 5:
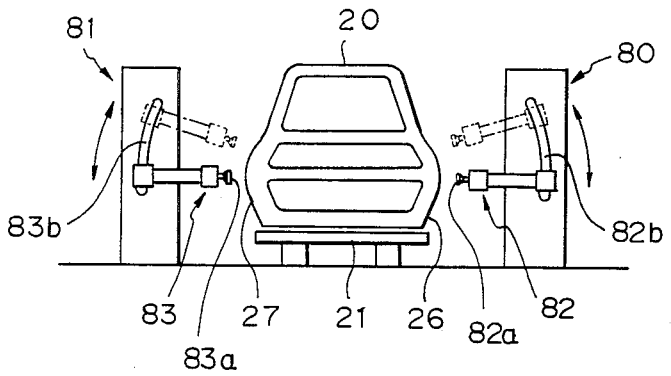
FIG. 5 shows a front view of a second spray mechanism.

FIG. 5 shows a contour-following rotary type electrostatic spray painting device having spray heads moving up or down along a contour of a traverse section the side outer panels 26 and 27 in such a manner that a substantially constant distance is maintained between the spray heads 22*a* and 25*a* and the side outer panels 26 and 27.

In FIG. 5, spray control devices 80 and 81 are located downstream of the devices 23 through 26 and are disposed alongside the side outer panels 26 and 27 of the automobile body 20. The spray control device 80 carries a rotary type electrostatic spray painting device 82 having a spray head 82*a* for painting the side outer panel 26, and the spray control device 81 carries a rotary type electrostatic spray painting device 83 having a spray head 83a for painting the side outer panel 27. The construction of the spray control devices 80 and 81 is symmetrical, and the construction of the rotary type electrostatic spray painting devices 82 and 83 is also symmetrical. The spray heads 82a and 83a are supported by guides 82b and 83b, respectively, in such a manner that the spray heads 82a and 83a are located adjacent to the side outer panels 26 and 27, and move up or down along the guides 82b and 83b while maintaining a substantially constant distance between the spray heads 82a and 83a and the side outer panels 26 and 27. Namely, the guides 82b and 83b are formed into a shape corresponding to the contour of the transverse section of the automobile body 20. The construction of the rotary type electrostatic spray painting devices 82 and 83 is the same, except for the guides 82b and 83b, as the devices shown in FIG. 2, and therefore, a detailed explanation of the construction is omitted here. Operation of the rotary type electrostatic spray painting devices 82 and 83 is controlled by the electronic control unit 70 shown in FIG. 4.

Figure 6:
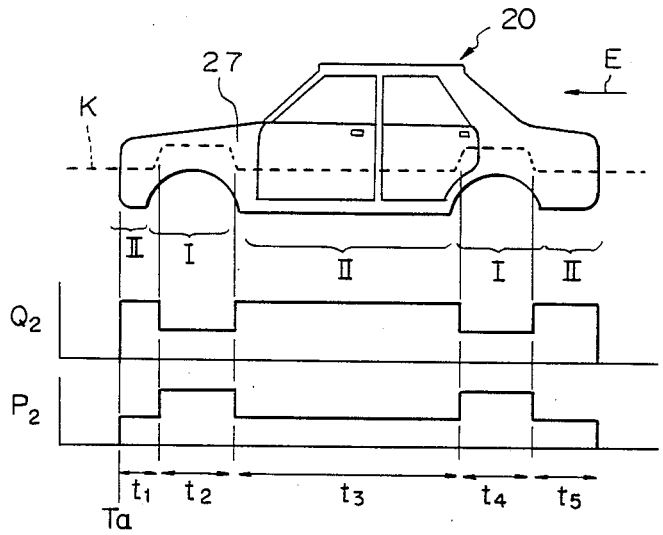
FIG. 6 shows a time chart of a painting process by the second spray mechanism.

Operation of the contour-following rotary type electrostatic spray painting device shown in FIG. 5 will be described below with reference to FIG. 6. Note, in FIG. 6 an arrow E shows a direction in which the automobile body 20 is conveyed, and a broken line K on the side outer panel 27 shows a position of the spray head 83a during the painting operation. Also, in FIG. 6, $Q_2$ denotes the quantity of paint supplied, and $P_2$ denotes the quantity of air injected from the air injection port 54.

The position of the spray head 83a is controlled by an oil hydraulic cylinder (not shown), and the quantity of paint supplied $Q_2$ and quantity of air injected $P_2$ are controlled by control valves (not shown). In FIG. 6, the painting process starts at a time Ta. Before the time Ta, that is, before starting the painting process, the position of the spray head 83a is set to the lowest point as shown by the broken line K. After the time Ta, a negative high voltage is applied to the spray head 83a, and the supply of paint and the injection of air are started. As seen from FIG. 6, during the period $t_2$ in which the first outer panel portion I situated over the front wheel is painted, and during the period $t_4$ in which the first outer panel portion I situated over the rear wheel is painted, the quantity of paint supplied $Q_2$ is decreased and the quantity of air injected $P_2$ is increased, in comparison with the periods $t_1$, $t_3$ and $t_5$ in which the second outer panel portions II are painted. Therefore, during the periods $t_2$ and $t_4$, the spray head 83a sprays a relatively small quantity of paint onto the first outer panel portions I, and the angle of spread of the sprayed paint is relatively narrow. Conversely, during the periods $t_1$, $t_3$ and $t_5$, the spray head 83a sprays a relatively large quantity of paint onto the second outer panel portions II, and the angle of spread of the sprayed paint is relatively wide. As seen from FIG. 6, the spray head 83a moves up or down substantially in accordance with an outline of the side outer panel 27. That is, the spray head 83a is positioned at an upper point when facing the first outer panel portions I, and at a lower point when facing the second outer panel portions II, so that the spray head 83a faces a point about midway between the top and bottom of each outer panel portion I and II, respectively. Thus, the spray head 83a sprays a uniform coating of paint onto the side outer panel 27.

Figure 7:
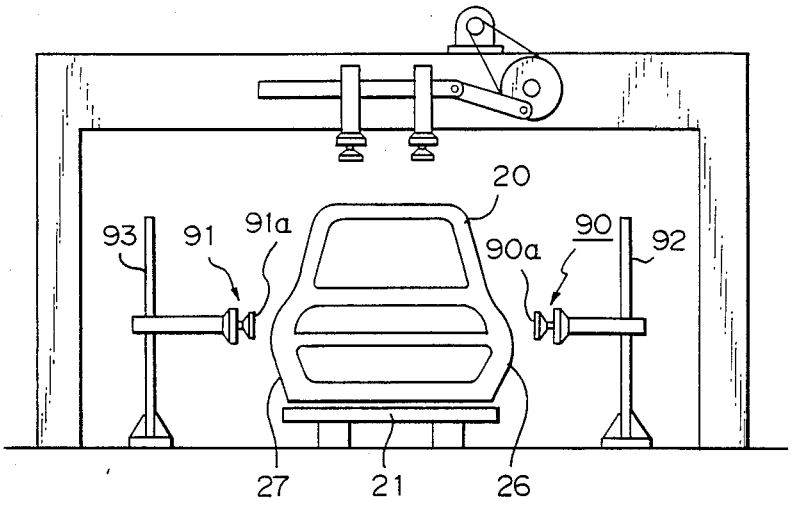
FIG. 7 shows a front view of a rotary type electrostatic spray painting device having horizontally reciprocating spray heads and a fixed type second spray mechanism.

FIG. 7 shows fixed mounting rotary type electrostatic spray painting devices having spray heads which are fixed at a constant height to spray paint onto side outer panels of the automobile body, and horizontally-reciprocating rotary type electrostatic spray painting devices having spray heads which reciprocate horizontally to spray paint onto the upper panel of the automobile body. In FIG. 7, fixed-mounting rotary type electrostatic spray painting devices 90 and 91 comprise a pair of floor-mounted pole supports 92 and 93, and spray heads 90a and 91a fixed at predetermined heights on the pole supports 92 and 93. That is, the spray heads 90a and 91a face a predetermined point of the side outer panels 26 and 27 to spray paint thereonto. The construction of the horizontally-reciprocating rotary type electrostatic spray painting devices is the same as that shown in FIG. 1. These devices 90 and 91 replace the contour-following rotary type electrostatic spray painting devices 80 and 81, and are located downstream of the vertically-reciprocating rotary type electrostatic spray painting devices 22 and 25 shown in FIG. 1.

Figure 8:
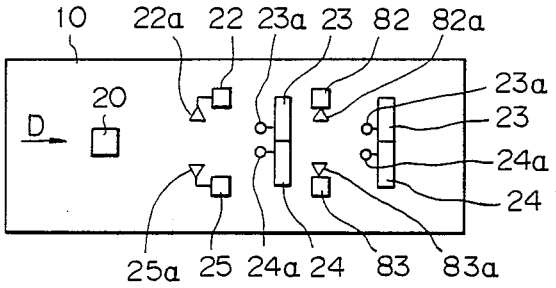
FIG. 8 shows a schematic plan view of an arrangement of a first embodiment of a spray painting device according to the present invention.

FIG. 8 shows an arrangement of electrostatic spray painting devices of the first embodiment of the present invention. In this arrangement, the outer panels 26, 27 and 28 of the automobile body 20 are sprayed with two coatings of paint. The automobile body 20 is moved in the direction shown by the arrow D, at a constant speed, in a painting booth 10. During this movement, the side outer panels 26 and 27 are sprayed with paint by the spray heads 22a and 25a of the vertically-reciprocating rotary type electrostatic spray painting devices 22 and 25, and the upper outer panel 28 is sprayed with paint by the spray heads 23a and 24a of the horizontally-reciprocating rotary type electrostatic spray painting devices 23 and 24, which are located at a first stage. The spray heads 22a and 25a move up and down during the movement of the automobile body 20, but stop moving up and down while spraying paint onto the first outer panel portions I (FIG. 3). Thus, the line of movement of the spray heads 22a and 25a on the side outer panels 26 and 27 is as shown by a broken line $L_1$ in FIG. 11a. At the same time the upper outer panel of the automobile body 20 is sprayed with paint by the horizontally-reciprocating rotary type electrostatic spray painting devices 23 and 24 having spray heads 23a and 24a which move to the right and left about the center line of the upper outer panel. Thus, the spraying of one coat of paint on the automobile body 20 is carried out.

Then, the outer panels of the automobile body 20 are sprayed with paint by the spray heads 82a and 83a of the contour-following rotary type electrostatic spray painting devices 82 and 83 and the spray heads 23a and 24a of the horizontally-reciprocating rotary type electrostatic spray painting devices 23 and 24. These electrostatic spray painting devices 82, 83, 23 and 24 are located at a second stage. The spray heads 82aand 83a move up or down along the contour line of the transverse section of the side outer panels 26 and 27 (FIG. 5) in such a manner that a substantially constant distance is maintained between the spray heads 82a and 83a and the side outer panels 26 and 27. Thus, the line of movement of painting of the side outer panels 26 and 27 is as shown by a broken line $L_2$ in FIG. 11b. At the same time, the upper outer panel 28 of the automobile body 20 is sprayed with paint by the spray heads 23a and 24a of the horizontally-reciprocating rotary type electrostatic spray painting devices 23 and 24, as for the upper outer panel 28 during the first stage. Thus, the spraying of two coatings of paint on the side and upper outer panels 26, 27 and 28 of the automobile body 20 is completed.

Figure 9:
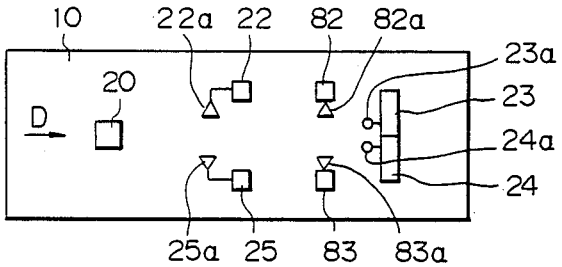
FIG. 9 shows a schematic plan view of an arrangement of a second embodiment of a spray painting device according to the present invention.

FIG. 9 shows an arrangement of electrostatic spray painting devices of a second embodiment of the present invention. In this embodiment, the side outer panels 26 and 27 are sprayed with two coats of paint, and the upper outer panel 28 is sprayed with one coat of paint. The side outer panels 26 and 27 are sprayed with paint by the spray heads 22*a* and 25*a* of the vertically-reciprocating rotary type electrostatic spray painting devices 22 and 25, and then sprayed with paint by the spray heads 82 and 83*a* of the contour-following rotary type electrostatic spray painting devices 82 and 83. After the side outer panels have been painted, the upper outer panel 28 is sprayed with paint by the spray heads 23*a* and 24*a* of the horizontally-reciprocating rotary type electrostatic spray painting devices 23 and 24.

Figure 11A:
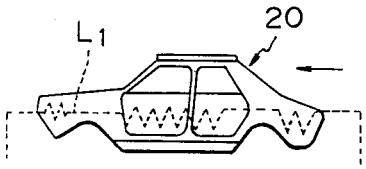
FIG. 11*a* shows a side view of an automobile body with a line of movement of a spray head in a first spraying step of the first and second embodiments marked thereon.
Figure 11B:
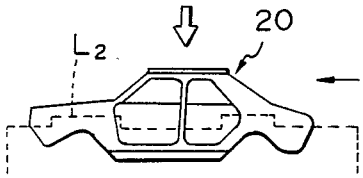
FIG. 11*b* shows a side view of an automobile body with a line of movement of a spray head in a second spraying step of the first and second embodiments marked thereon.

According to this second embodiment, the line of movement of the spray heads when painting the side outer panels 26 and 27 is as shown by the broken line $L_1$ during the process of the painting by the devices 22 and 25, and by the broken line $L_2$ during the process of the painting by the devices 82 and 83, as shown in FIG. 11*a* and 11*b*.

Figure 10:
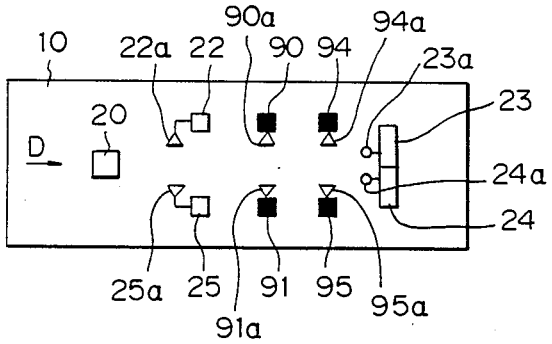
FIG. 10 shows a schematic plan view of an arrangement of a third embodiment of a spray painting device according to the present invention.

FIG. 10 shows an arrangement of electrostatic spray painting devices of a third embodiment of the present invention. In this embodiment, the side outer panels 26 and 27 are sprayed with two coats of paint, and the upper outer panel 28 is sprayed with one coat of paint. First, the side outer panels 26 and 27 are sprayed with paint by the spray heads 22*a* and 25*a* of the vertically-reciprocating rotary type electrostatic spray painting devices 22 and 25. Then the side outer panels 26 and 27 are sprayed with paint by the spray heads 90*a* and 91*a* of the fixed-mounting rotary type electrostatic spray painting devices 90 and 91, and sprayed with paint by the spray heads 94*a* and 95*a* of the fixed-mounting rotary type electrostatic spray painting devices 94 and 95. The painting devices 90 and 91 are located upstream of the painting devices 94 and 95. The spray heads 90*a* and 91*a* are fixed at a relatively high position, and the spray heads 94*a* and 95*a* are fixed at a relatively low position. The height at which the spray heads 90*a* and 91*a* are positioned corresponds substantially to a point midway between the top and bottom of the first outer panel portions 1 (FIG. 12*b*) which are situated over the front and rear wheels of the automobile chassis, and the height at which the spray heads 94*a* and 95*a* are positioned is at a point lower than the bottom of the first outer panel portions I. Therefore, the spray heads 90*a* and 91*a* spray paint onto the first outer panel portions I and an upper portion of the second outer panel portions II, while the spray heads 94*a* and 95*a* spray paint only onto a lower portion of the second outer panel portions II. After the side outer panels are painted, the upper outer panel 28 is sprayed with paint by the spray heads 23*a* and 24*a* of the horizontally-reciprocating rotary type electrostatic spray painting devices 23 and 24.

Figure 12A:
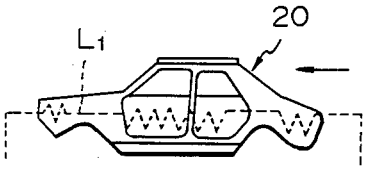
FIG. 12*a* shows a side view of an automobile body with a line of movement a spray head in a first spraying step of the third embodiment marked thereon.
Figure 12B:
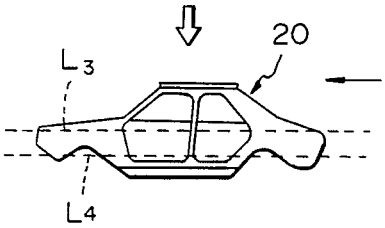
FIG. 12*b* shows a side view of an automobile body with a line of movement of a spray head in a second spraying step of the third embodiment marked thereon.

According to the third embodiment, the line of movement of the spray heads when painting the side outer panels 26 and 27 is shown by the broken line $L_1$ during the process of the painting by the devices 22 and 25, by the broken line $L_3$ during the process of the painting by the devices 90 and 91, and by the broken line $L_4$ during the process of the painting by the devices 94 and 95, as shown in FIGS. 12*a* and 12*b*.

As described above, in each embodiment the spray painting is carried out by the vertically-reciprocating rotary type electrostatic spray painting devices 22 and 25, the horizontally-reciprocating rotary type electrostatic spray painting devices 23 and 24, and the contour-following rotary type electrostatic spray painting devices 82 and 83, or the fixed-mounting rotary type electrostatic spray painting devices 90, 91, 94, and 95. That is, first, the side outer panels 26 and 27 are sprayed with paint by the spray heads 22*a* and 25*a* moving up and down (spraying movement shown by line $L_1$ in FIGS. 11*a* and 12*a*). Then, the side outer panels 26 and 27 are sprayed with paint by the spray heads 82*a* and 83*a* moving substantially along the outline of the side outer panels 26 and 27 (spraying movement shown by line $L_2$ in FIG. 11*b*), or are sprayed with paint by the spray heads 90*a*, 91*a*, 94*a*, and 95*a* fixed at a predetermined height (spraying movement shown by lines $L_3$ and $L_4$ in FIG. 12*b*). In other words, the side outer panels 26 and 27 are first sprayed with paint by the vertically-reciprocating rotary type painting devices 22 and 25, and then are sprayed with paint by the contour-following rotary type painting devices 82 and 83 or the fixed-mounting rotary type painting devices 90, 91, 94, and 95 as the finishing coat. By using the vertically-reciprocating rotary type painting devices 22 and 25, the side outer panels 26 and 27 are coated with paint to a predetermined thickness, and after the painting by the devices 22 and 25, the side outer panels 26 and 27 are painted by the contour-following rotary type painting devices 82 and 83 or the fixed-mounting rotary type painting devices 90, 91, 94, and 95, while maintaining a substantially constant distance between the side outer panels and the spray heads so that the painted surfaces on the side outer panels 26 and 27 are made very smooth.

Figure 13:
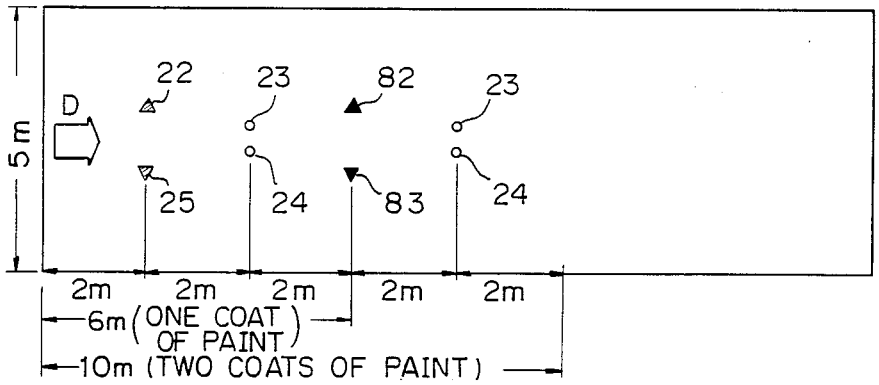
FIG. 13 shows a schematic plan view of an arrangement of spray heads of the first embodiment.
Figure 14:
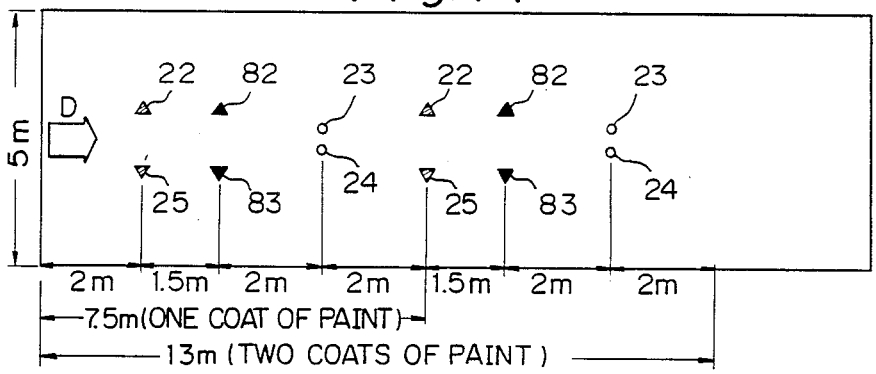
FIG. 14 shows a schematic plan view of an arrangement of spray heads of the second embodiment.
Figure 15:
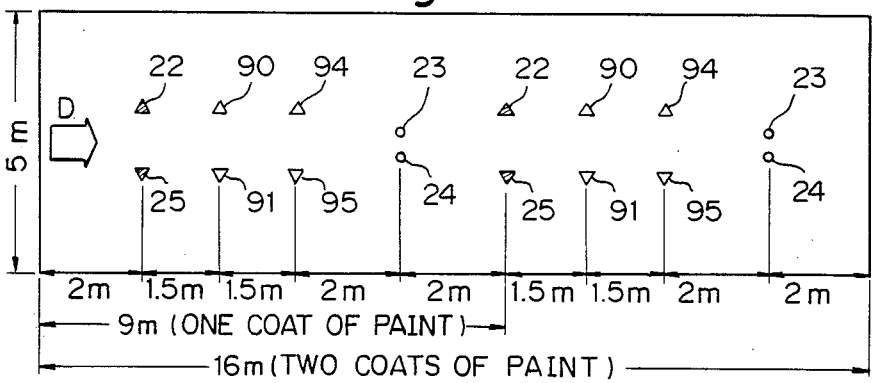
FIG. 15 shows a schematic plan view of an arrangement of spray heads of the third embodiment.

FIG. 13 through 15 show the space in which the painting devices of each above embodiment are disposed, respectively.

FIG. 13 shows a disposition of the painting devices in the first embodiment. The painting devices are disposed at intervals of about 2 m in this embodiment. For a one-coat painting process, the painting devices 22, 25, 23, and 24 are used, so that a length of 6 m is needed for the painting booth 10, and for a two-coat painting process, the painting devices 22, 25, 23, 24, 82, 83, 23, and 24 are used, so that a length of 10 m is needed for the painting booth 10. Note that the breadth of the painting booth 10 is 5 m.

FIG. 14 shows a disposition of the painting devices in the second embodiment. The painting devices 22, 25 and the painting devices 82, 83 are disposed at intervals of 1.5 m, and the distance between the other painting devices is 2 m. The painting devices 22, 25, 82, 83, 23 and 24 are used for the one-coat painting process, and therefore, a length of 7.5 m is needed, and two groups of the painting devices 22, 25, 82, 83, 23 and 24 are used for the two-coat painting process, and therefore, a length of 13 m is needed, for the painting booth 10, respectively.

FIG. 15 shows a disposition of the painting devices in the third embodiment. The distance between the painting devices 22, 25 and 90, 91 is 1.5 m, and the distance between the painting devices 90, 91 and 94, 95 is also 1.5 m. The distance between the other painting devices is 2 m. The painting devices 22, 25, 90, 91, 94, 95, 23 and 24 are used for the one-coat painting process, and therefore, a length of 9 m is needed, and two groups of the painting devices 22, 25, 90, 91, 94, 95, 23 and 24 are used for the two-coat painting process, and therefore, a length of 16 m is needed, for the painting booth 10, respectively.

In the third embodiment shown in FIG. 15, if the vertically-reciprocating rotary type painting devices 22 and 25 are changed to the fixed-mounting rotary type painting devices 90, 91, 94 and 95, the arrangement is the same as for a conventional painting system. That is, if only the fixed-mounting rotary type painting devices are provided, the painting booth must have a length of about 9 m for a one-coat painting process, and a length of about 16 m for a two-coat painting process.

As understood from the above description, the arrangements of the first embodiment (FIG. 13) and the second embodiment (FIG. 14) drastically shorten the length of the painting booth 10 in comparison with a conventional painting system, so that a two-coat painting process can be carried out in a relatively small space. Although the booth in the third embodiment (FIG. 15) is about the same length as for a conventional painting system, since the vertically reciprocating type painting devices spray paint onto the whole of the side outer panels, any of the fixed-mounted rotary type painting devices 90, 91, 94 and 95 can be omitted, so that the length of the painting booth can be reduced.

While embodiments of the present invention have been described herein with reference to the attached drawings, many modifications and changes may be made by those skilled in this art without departing from the scope of the invention.

We claim:

1. A method for painting side outer panels of an automobile body conveyed along an assembly line, said automobile body having first outer panel portions which are situated over front and rear wheels of an automobile, and second outer panel portions which are not situated over said front and rear wheels, said side outer panels being sprayed with paint by spray heads located adjacent to said side outer panels and spraying paint onto said side outer panels, said method comprising the steps of:

first, spraying paint onto said first outer panel portions with said spray heads fixed at a point substantially midway between the top and bottom of said first outer panel portions, and spraying paint onto said second outer panel portions while said spray heads are moved up and down about a point substantially midway between the top and bottom of said second outer panel portions; and second, spraying paint uniformly onto said outer panels with said spray head located so as to maintain a substantially constant distance between said spray heads and said side outer panels while maintaining said spray heads vertically fixed when spraying said second outer panel portions, said second spraying step being carried out after said first spraying step, whereby the automobile body is painted in a compact space with a paint coating having both high reflectivity and good smoothness as compared to a paint coating produced by the first spraying step along.

2. A method according to claim 1, wherein in said first spraying step, said spray heads spray a relatively small quantity of paint onto said first outer panel portions, and spray a relatively large quantity of paint, which is larger than said relatively small quantity, onto said second outer panel portions, and wherein an angle of spread of the sprayed paint is relatively narrow when said paint is sprayed onto said first outer panel portions, and relatively wider than said narrow angle when said paint is sprayed onto said second outer panel portions.

3. A method according to claim 1, wherein, in said second spraying step, said spray heads are moved up or down substantially in accordance with an outline of said side outer panels.

4. A method according to claim 3, wherein said spray heads spray a relatively small quantity of paint onto said first outer panel portions, and spray a relatively large quantity of paint, which is larger than said relatively small quantity, onto said second outer panel portions, wherein an angle of spread of the sprayed paint is relatively narrow when said paint is sprayed onto said first outer panel portions, and relatively wider than said narrow angle when said paint is sprayed onto said second outer panel portions.

5. A method according to claim 1, wherein high and low spray heads are provided for said second spraying step, said high spray heads spraying paint onto said first and second outer panel portions at a first constant height which substantially corresponds to said point midway between the top and bottom of said first outer panel portions, and said low spray heads spraying paint onto said second outer panel portions at a second constant height which is lower than the bottom of said first outer panel portions.

* * * * *